United States Patent [19]

Helinski

[11] 4,242,658

[45] Dec. 30, 1980

[54] MAGNETIC ACTUATOR USING MODULATED FLUX

[75] Inventor: Edward F. Helinski, Johnson City, N.Y.

[73] Assignee: International Business Machines Corporation, Armonk, N.Y.

[21] Appl. No.: 974,297

[22] Filed: Dec. 29, 1978

[51] Int. Cl.[3] ..... H01F 7/18

[52] U.S. Cl. ..... 335/237; 101/93.29; 101/93.48; 335/230

[58] Field of Search ..... 335/237, 236, 235, 234, 335/233, 232, 231, 230, 229; 101/93.04, 93.29-93.34, 93.48; 361/152

[56] References Cited

U.S. PATENT DOCUMENTS

| | | | |
|---|---|---|---|
| 3,146,381 | 8/1964 | Moreau | 335/237 |
| 4,020,433 | 4/1977 | Uchidoi et al. | 335/230 |

*Primary Examiner*—Harold Broome

*Attorney, Agent, or Firm*—Kenneth P. Johnson

[57] ABSTRACT

Magnetic actuator arrangement in which the actuator or armature is retained in a cocked position by unidirectional magnetic flux having a density that cyclically varies in magnitude with time and is released by selective energization of a bucking coil to counteract the retention flux when the flux density is less than maximum. The modulated retaining flux may be made sufficient at its maximum density to retract the released actuator to the cocked position.

11 Claims, 3 Drawing Figures

MAGNETIC ACTUATOR USING MODULATED FLUX

This specification contains subject matter related to that disclosed and claimed in an application for a United States patent entitled "Low Energy Magnet Actuator" bearing Ser. No. 974,298 filed by J. C. Tamulis on the date of this application and commonly assigned.

BACKGROUND OF THE INVENTION

This invention pertains generally to electromagnet actuators and more particularly to such actuators in which the armature is retained against a biasing force in a retracted position by magnetic attraction until selectively released to an actuating or extended position.

Electromagnetic actuators such as relays or print hammers are well known in which a magnetic armature is released from an attracted position by a counteracting bucking coil. The magnetic holding flux in such devices may be generated by a permanent magnet or electromagnetic coils energized by either direct or alternating current. Reset of the armature or actutator is accomplished by terminating the energization of the bucking coil while maintaining the normal holding flux, providing a supplemental flux generator or mechanical reset device.

These actuators frequently comprise a multi-legged core, usually three legs, to provide alternate flux paths along which the primary magnetomotive force can be diverted by the bucking coil to accomplish release of the armature. Although the holding force can be generated by an alternating current coil, the holding flux source is preferably produced by means of a direct current coil or permanent magnet because of the fast operating times, smaller size and low input energy requirements. Examples of A.C. actuators are shown in U.S. Pat. Nos. 2,509,835 and 3,389,310. In each of these, the primary magnetomotive force is provided by an A.C. coil and release or attraction of the armature or actuator is controlled by opening or shorting a secondary coil on the center leg of the core which is operable to divert the holding flux either to or away from the armature. In U.S. Pat. Nos. 1,956,279 and 3,659,238, permanent magnets are employed as one leg of the core member, and bucking coils are attached to another leg to selectively counteract primary holding flux away from the core leg which retains the actuator.

In each of these references, the selectively operable bucking coil must be supplied with an amount of energy sufficient to reduce the flux in the armature or actuator leg of the core, which is usually some constant quantity. In a low duty cycle or low frequency operation, the input energy is of little consequence; however, in applications requiring a high duty cycle or high frequency operation, input energy becomes significant, causing heating or requiring the use of larger, more expensive components to handle the necessary current.

OBJECTS AND SUMMARY OF THE INVENTION

It is accordingly a primary object of this invention to provide a magnetic control circuit for an actuator which requires markedly less input energy to the bucking coil during release of the actuator.

Another object of this invention is to provide an electromechanical actuator having at least two alternate flux paths in which the reluctance of one path is cyclically varied, and bucking coil energization is coordinated with the occurence of lower reluctance in the one path to produce release of the actuator in the second flux path.

A further object of this invention is to provide an electromechanical actuator having one flux path for releasably restraining the actuator and another parallel path of cyclically variable reluctance to consequentially cyclically vary the flux density of the first path, and having a bucking coil energizable at times of decreased flux density to release the actuator with less electrical input energy.

A still furter object of this invention is to provide an electromechanical actuator that can be compactly constructed and combined with other actuators while using some componenets jointly.

The foregoing objects are attained in accordance with the invention by providing a modified three-legged magnetic core in which the first or center leg is a permanent magnet, the second leg includes a movable actuator biased toward an operative position and the third leg includes means to vary the reluctance thereof. Flux from the permanent magnet source has parallel paths through the second and third legs with the principal flux path being through the actuator, which serves as the armature, and with the minor flux path being through the variable reluctance. Reluctance variations are produced by an air gap having a cyclically rotatable, magnetically permeable member to change the permeance of the gap. A bucking coil is placed in one of the paths and coincidentally energized to divert flux from the principal path at a time when the rotated member is aligned with a pair of poles in the third leg to provide minimum reluctance. Actuator release occurs when flux density is reduced in the actuator leg and greater in the variable reluctance path and thus requires less input energy to divert a smaller portion of the holding flux. When the bucking coil energization is terminated and the rotating number cycles to greater reluctance, the magnetomotive force of the permanent magnet is able to recapture the released actuator.

The invention has the advantage of providing unidirectional flux flow through the permanent magnet while producing a cyclically varying force retaining the armature or actuator. As long as the actuator is attracted against one of the pole faces in its leg of the core, the flux density therein can be reduced to low values because of the close proximity of the actuator and pole. The disclosed arrangement also permits a plurality of actuators to jointly use common components and reduce the number of current drivers.

The foregoing and other objects, features and advantages of the invention will be apparent from the following more particular description of preferred embodiments of the invention, as illustrated in the accompanying drawing.

BRIEF DESCRIPTION OF THE DRAWING

FIGS. *2a*, *2b* and *2c* are waveforms representing magnetic flus density, coil current, and actuator displacement for the apparatus in FIG. 1.

DETAILED DESCRIPTION

Figure 1:
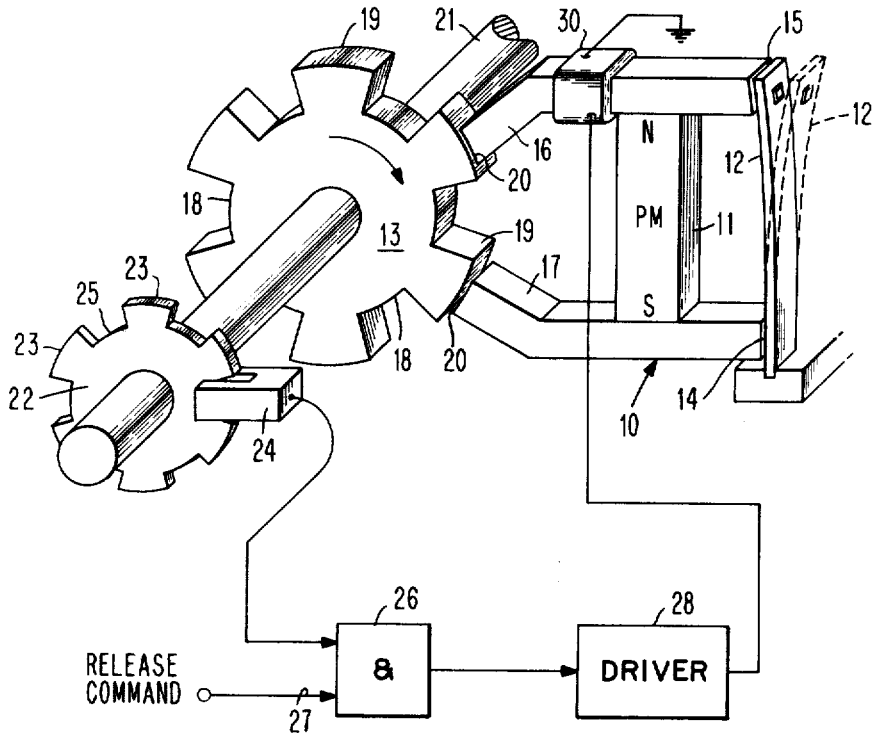
FIG. 1 is a schematic diagram of a magnetic actuator incorporating the principles of the invention.

Referring to FIG. 1, the magnetic actuator device according to the invention comprises generally a magnetic core member 10 having a permanent magnet 11 as a center leg, an armature-actuator 12 as one outside leg and a reluctance control member 13 as the other outside leg. Actuator 12 is illustrated as a print hammer and is of a resilient material that is magnetically permeable. It may be of spring steel, for example, and is attached to pole face 14 or supported in contact therewith. The actuator is biased away from pole face 15, but held in contact with the latter due to the magnetic flux therethrough at pole faces 14 and 15 from the permanent magnet.

The third leg of magnetic core 10 is formed with a pair of core extensions 16 and 17 serving as poles, which are closely proximate to rotating disk 13, having cutouts 18 and sectors 19, and is also of a magnetically permeable material. Gaps 20 between the ends of poles 16 and 17 and rotating sectors 19 are made small to minimize the reluctance of the third leg of the core arrangement. Disk 13 is fixed to shaft 21 which is rotated by any suitable means, such as a motor, not shown. Also affixed to shaft 21 is a slotted timing disk 22 having opaque sectors 23. Adjacent to and straddling the timing disk is a transducer housing 24 containing position sensing means, such as light-emitting and light-sensitive diodes, for sensing opening 25 between the sectors. This transducer is used to provide a gating signal at coincidence circuit 26 for releasing the actuator. Circuit 26 has as a second input a Release Command signal on line 27. Upon coincidence of these two signals, driver circuit 28 is activated to energize bucking coil 30 on the upper core extension 16 of core member 10. The bucking coil is wound such that, when energized, it increased the flux density from the permanent magnet through the variable reluctance at core extensions 16 and 17.

In operation, the majority of the magnetic flux from permanent magnet 11, occurs in the loop comprising pole face 15, actuator 12, and pole face 14 back to the magnet. However, with slotted disk sectors 19 in the position shown and with bucking coil 30 de-energized, there is also flux through core extension 16 and disk 13, back through core extension 17 to the magnet.

During rotation of disk 13, sectors 19 and cutouts 18 alternately pass adjacent to core extensions 16 and 17 so that the air gaps 20 and the reluctance thereof vary cyclically. The effect of the rotation is to change the amount of and thus the density of flux through the actuator leg of the magnetic core. An idealized waveform of the flux density, through the actuator is indicated in FIG. 2 at waveform (a) in which the flux density through the actuator is indicated as a usually undulating value.

When the actuator is to be released, bucking coil 30 is energized approximately at the time when the actuator flux density is least or at its lowest point on curve (a) and when the flux through poles 16 and 17 and rotating disk 13 is at its greatest. Timing disk 22 and transformer 24 indicate the position of sectors 19 with respect to the core extensions 16, 17 and provide a gating signal at coincidence circuit 26. Upon the concurrence of a release control signal in conjunction therewith, a pulse is generated from driver 28 to energize bucking coil 30 (as at 31, waveform (b) and produce more flux through the adjacent magnetic sectors 19. This additional flux is in opposition to the flux through poles 14, 15 and actuator 12 which is already at a low density. (See point 32, waveform a). This reduction is sufficient to lower the actuator holding force below the bias force of the actuator 12 allowing it to move outwardly to its operative position (shown in phantom).

Figure 2:
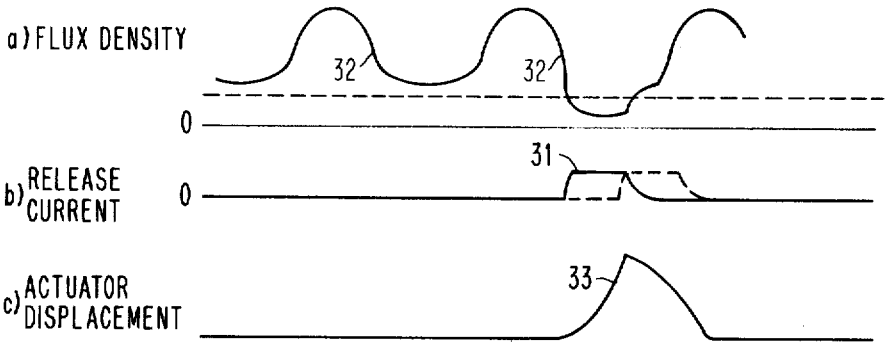

The application of release current 31 and resulting actuator displacement 33 are shown in waveforms (b) and (c) of FIG. 2. The dotted line of waveform (a) indicates the threshold of the holding force below which the biased actuator will overcome the attracting forced pole face 15. The release pulse need only be of duration sufficient to accomplish release. As the actuator rebounds or moves to an undeflected neutral position from its operative position, and with the bucking coil pulse terminated, there is sufficient flux at pole face 15 to reattach the actuator in the retracted position. It will also be noted from waveform (a) that the flux density is increasing since the reluctance is increasing in the opposite leg of the core member at disk 13. The permanent magnet is preferably selected to provide only sufficient magnetic flux to maintain actuator 12 in the attracted position during the time of minimum flux density in its leg. If the flux source is excessive the flux variations become small so that the advantage of lower bucking current is lost. This precaution applies also to the embodiments hereinafter described.

Figure 3:
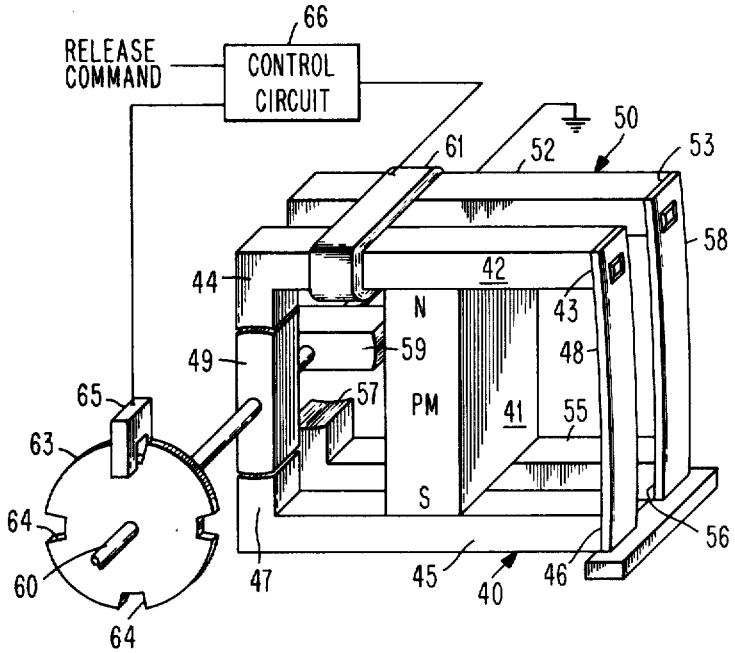
FIG. 3 is a schematic diagram of a modification of the actuator shown in FIG. 1 in which multiple actuators use elements in common.

The magnetic actuator apparatus of FIG. 3 is similar in principle to that shown in FIG. 1 but has been modified to illustrate that a plurality of actuators can be selectively and independently operated even though a common permanent magnet, common bucking coil, and common variable reluctance element drive means are employed. A single permanent magnet 41 forms the center leg in both magnetic device 40 and magnetic device 50. Magnetic device 40 has a first core member 42 with poles 43 and 44, and a second core member 45 having poles 46 and 47. Resilient, biased actuator 48 is secured to pole 46 and attracted to pole 43. Variable reluctance element 49 of magnetically permeable material is fixed on rotatable shaft 60 and provides a low reluctance flux path when aligned with poles 44 and 47 in the position shown.

Magnetic device 50 is closely similar to device 40 in physical and magnetic properties and has a first core member 52 with pole face 53 and one, not shown, equivalent to pole 44, and a second core member 55 with pole faces 56 and 57. Resilient, biased actuator 58 is secured to pole 56 and magnetically attracted to corresponding pole 53. Variable reluctance element 59 is secured to shaft 60, but is displaced on the shaft (shown here as 90°) with respect to reluctance element 49. A bucking coil 61 is commonly wound about both core members 42 and 52. Shaft 60 also carries timing disk 63 having cutouts 64 effective to produce gating signals via transducer 65, as in FIG. 1, for control circuit 66.

In operation, the majority of the flux from magnet 41 in device 40 passes through pole 43, actuator 48, and pole 46, and in device 50 passes through pole 53, actuator 58 and pole 56. When the respective variable reluctance elements 49 or 59 are each successively aligned with their corresponding poles 44, 47 or 57, a portion of the holding flux for the actuators is diverted through that variable reluctance element and decreases the flux density in actuators 48 and 58. As shaft 60 is rotated, the flux density and magnetomotive force holding actuators 48 and 58 will vary cyclically and out of phase with each other.

By appropriately positioning transducer 65 with respect to cutouts 64, gating signals are produced at control circuit 66 to permit a Release Command to be generated in bucking coil 61. The bucking coil is wound about both pole numbers 42 and 52, but its energization is effective to produce additional flux that is sufficient to release only the actuator whose variable reluctance element 49 or 59 is in an appropriate range of alignment with the corresponding core poles. The current supplied to the bucking coil 61 need be only that necessary to effect release of an actuator when the reluctance of its corresponding alternate flux path is near the minimum value. It will be noted that, for the position shown, energization of the bucking coil will effect release only of actuator 48 and be ineffectual for the other actuator. Further note should be made that other configurations of the reluctance elements and their respective displacements on shaft 60 can be made to accommodate additional actuator devices to optimize flux variations.

Although different structures have been shown for obtaining cyclically varying unidirectional flux densities for an actuator, still other modifications can be made. These include the substitution of an electromagnetic holding coil for the permanent magnet, or variations in the permanent magnetic materials used. Other arrangements of rotating multiple electromagnets can be used. The bucking coil can be relocated to the opposite flux loop or to the other core member; relocation may then require a different current input to effect release. The magnetic actuator has been shown in the two embodiments as having spring qualities and being mounted so as to be stressed toward an operating position away from the restraining pole face. As an alternative, the actuator can be a separately supported element which is resiliently urged to an operative position by a compression or tension spring. Further, the actuator can be reset either by a supplemental winding or mechanical device if reset is beyond the capability of the flux source employed.

While the novel features of the present invention have been shown and described with reference to preferred embodiments thereof, it will be understood by those skilled in the art that the foregoing and other changes can be made in the form and details without departing from the spirit and scope of the invention.

Having thus described my invention, what I claim as new, and desire to secure by Letters Patent is:

1. Magnetic actuator apparatus comprising, in combination:

magnetic core means having a pair of pole pieces;

means for producing unidirectional magnetic flux in said core structure at said pole pieces cyclically varying between high and low flux densities;

actuator means of magnetically permeable material attracted across said pole pieces in a captured position by said varying flux and being biased toward a released position; and means selectively operable when said varying flux is less than said high density for further reducing said magnetic flux to a level permitting release of said actuator means.

2. Apparatus as described in claim 1 wherein said means for producing cyclically varying magnetic flux density includes a rotating member.

3. Apparatus as described in claim 2 wherein said rotating member is a disk of magnetically permeable material.

4. Apparatus as described in claim 1 wherein said means for producing cyclically varying magnetic flux densities comprises means for varying an air gap of said magnetic core means.

5. Apparatus as described in claim 1 wherein said selectively operable means includes timing means for synchronizing the reduction of said magnetic flux with said low density level.

6. Magnetic actuator apparatus comprising, in combination:

magnetic core means having first and second pairs of poles;

a source of unidirectional magnetic flux producing flux paths across the corresponding poles of both of said pairs;

actuator means of magnetically permeable material attracted across said first pole pair to a captured position by the flux thereacross against a bias force toward a released position;

means for cyclically varying the reluctance across said second pole pair between predetermined maximum and minimum values to vary the density of flux through said actuator; and means selectively operable for further reducing the flux density at said first pole pair at a time other than during said maximum reluctance value at said second pole pair to a point sufficient to release said actuator means.

7. Apparatus as described in claim 6 wherein said means for varying the reluctance across said second pole pair is a rotatable toothed disk of magnetically permeable material for varying the air gap between the poles of said second pair.

8. Apparatus as described in claim 6 wherein said selectively operable means includes an energizable bucking coil and timing means for controlling the energization of said bucking coil.

9. Magnetic actuator apparatus comprising, in combination:

a source of magnetic flux;

magnetic core means having first and second pairs of poles and forming corresponding first and second parallel flux paths across said pole pairs;

means cyclically varying the magnetic reluctance of said first path at said first pole pair to correspondingly change the density of magnetic flux in said second path between minimum and maximum values at said second poles;

actuator means of magnetically permeable material attracted across said second pole pair to a captured position against a bias force toward a released position by said cyclically changing flux; and means selectively operable in said first path to decrease the density of flux in said second path at a time other than during maximum density therein to release said actuator means.

10. Magnetic actuator apparatus comprising, in combination:

first and second magnetic core means, each having a pair of pole pieces;

common means for producing unidirectional magnetic flux in each said core means at the respective pole pieces thereof cyclically varying between maximum and minimum flux densities, said variations in said first core means being out of phase with that of said second core means;

an actuator means of magnetically permeable material attracted across each of said pair of pole pieces in a captured position by said varying flux and being biased toward a released position; and means selectively operable for further reducing the magnetic flux concurrently in said first and second core means and effective only at said core means having said minimum flux density for causing release of the actuator means therefor.

11. Apparatus as described in claim 10 wherein said selectively operable means is a bucking coil commonly wound about both said core means.

* * * * *